United States Patent [19]

Coronado

[11] Patent Number: 4,503,981

[45] Date of Patent: Mar. 12, 1985

[54] DRAFTING TOOL SUPPORT APPARATUS

[76] Inventor: Rodolfo A. Coronado, 35012 Hollyhock St., Union City, Calif. 94587

[21] Appl. No.: 426,945

[22] Filed: Sep. 29, 1982

[51] Int. Cl.[3] ..... A47F 7/00

[52] U.S. Cl. ..... 211/69.5; 248/447; 248/454

[58] Field of Search ..... 211/69.5, 13, 69, 69.1; 248/447, 441.1; 403/298

[56] References Cited

U.S. PATENT DOCUMENTS

| | | | |
|---|---|---|---|
| 369,971 | 9/1887 | Stillman | 248/316 A X |
| 758,924 | 5/1904 | Law | 248/448 X |
| 1,026,506 | 5/1912 | Hard | 248/441 X |
| 1,128,324 | 2/1915 | Jones | 248/447 |
| 1,494,212 | 5/1924 | Bromley | 248/454 |
| 1,919,562 | 7/1933 | Kranzfelder | 211/13 X |
| 2,957,270 | 10/1960 | Kennamer | 211/69.5 |
| 3,164,254 | 1/1965 | Gorc | 211/69.5 X |
| 3,176,662 | 4/1965 | Williams | 211/69.5 |
| 4,264,013 | 4/1981 | Vollmer | 211/13 |
| 4,373,639 | 2/1983 | Tricon | 211/13 X |
| 4,406,368 | 9/1983 | Hermes | 211/69.1 X |

FOREIGN PATENT DOCUMENTS

| | | | |
|---|---|---|---|
| 841261 | 5/1970 | Canada | 403/298 |

*Primary Examiner*—Ramon S. Britts
*Assistant Examiner*—Sarah A. Lechok
*Attorney, Agent, or Firm*—Flehr, Hohbach, Test, Albritton & Herbert

[57] ABSTRACT

A drafting tool support apparatus especially suitably for mounting to an angularly adjustable table top of a drafting table is disclosed herein. This apparatus includes a shelf arrangement which is configured to support (1) rulers, erasers and the like on a longitudinally extending shelf, (2) pens and/or pencils in spaced relationship to one another in upwardly extending positions relative to the shelf, and (3) templates, triangles and the like on hooks fixedly supported adjacent and preferably under the shelf. The apparatus also includes means for mounting this shelf arrangement over and to one edge of the angularly adjustable table top in a way which allows the shelf arrangement to be adjusted vertically and horizontally to a limited extent as well as rotationally and which also allows the shelf to be maintained in a longitudinally horizontal position regardless of the angular position of the table top.

16 Claims, 8 Drawing Figures

DRAFTING TOOL SUPPORT APPARATUS

The present invention relates generally to support stands for drafting tools and more particularly to a specifically designed drafting tool support apparatus which is especially suitable for mounting to an angularly adjustable drafting table in a number of different adjusted positions for supporting rulers, erasers, pens and/or pencils as well as templates, triangles and other drafting tools so as to make them easily accessible to the draftsman.

It is not uncommon for a draftsman to use dozens of drafting tools at any one time. These tools typically include rulers, erasers, pens, pencils, triangles, templates and the like. As many as a dozen templates and triangles may be required for any one project. Because it is quite often necessary to quickly switch back and forth between these various tools, it is not uncommon for the draftsman to leave them on his drafting table where they tend to interfere with the actual drafting procedure and generally clutter up the working surface. This also makes it difficult for the draftsman to quickly find the tools he needs. While these problems could be eliminated by utilizing adjoining shelves and/or drawers, the latter are typically inconveniently located relative to the working surface of the drafting table and draftsmen will not always use them during a given project since that tends to be even more inconvenient than the clutter which results by using the table's working surface.

In view of the foregoing, it is a primary object of the present invention to provide the draftsman with a more attractive alternative for supporting (and storing) his drafting tools during a given project than the drafting table itself and particularly an alternative which he will tend to use.

A more specific object of the present invention is to provide a drafting tool support apparatus which may be readily mounted to an angularly adjustable table top of a drafting table in an adjustably positioned way which is most comfortable for the user.

Another specific object of the present invention is to provide a drafting tool support apparatus of the last-mentioned type which has vertical and horizontal adjustment capabilities as well as rotational and tilting capabilities so that the draftsman using the apparatus can support his drafting tools in as convenient a location as possible for his particular needs.

Still another particular object of the present invention is to provide a drafting tool support apparatus which supports rulers, erasers, pencils, pens, templates, triangles, and the like in ways which make them readily accessible and distinguishable from one another to the draftsman using them.

A further object of the present invention is to provide a drafting tool support apparatus having a specifically designed shelf arrangement (1) for reliably supporting rulers, erasers and the like, (2) for supporting pens and/or pencils in a way which protects their tips and (3) for supporting a relatively large number of triangles and templates apart from the rulers, erasers, pens and pencils.

Still a further object of the present invention is to provide separate hooks for supporting the above-mentioned triangles and templates and particular means of reliably supporting these hooks in fixed positions.

As will be described in more detail hereinafter, the drafting tool support apparatus disclosed herein includes a shelf arrangement and means for mounting this arrangement over and to one edge of an angularly adjustable table top providing the working surface of a drafting table. The shelf arrangement itself includes (1) means defining a longitudinally extending flat shelf for supporting rulers, erasers and the like, (2) means for supporting a plurality of upwardly extending pens and/or pencils in spaced-apart relationship to one another, and (3) means including a plurality of hooks for supporting templates, triangles and the like. The shelf arrangement is mounted to the drafting table's top by the mounting means so as to adjustably maintain the shelf in a longitudinally horizontal position regardless of the angular position of the table top.

In a preferred and actual working embodiment of the present invention, the shelf arrangement may be adjusted vertically relative to the top of the drafting table; it may be adjusted horizontally relative to the table top's mounting edge; and it may be adjusted rotationally. In addition, in this embodiment, the shelf arrangement includes a back wall extending up from the back edge of the shelf for aiding in supporting rulers, erasers and the like. This combination shelf/backwall may be adjustably tilted transversely (as opposed to longitudinally) along with the back wall such that the shelf tilts downward from its front edge to its back edge so as to more reliably support the rulers, erasers and the like.

The overall drafting tool support apparatus disclosed herein and discussed briefly above will be described in more detail hereinafter in conjunction with the drawings wherein:

FIG. 4 is an enlarged side elevational view of a feature of the apparatus illustrated in FIGS. 1 and 2, specifically a hook connected to and extending outwardly from a front wall support, both of which form part of the apparatus for supporting templates, triangles and the like;

Figure 1:
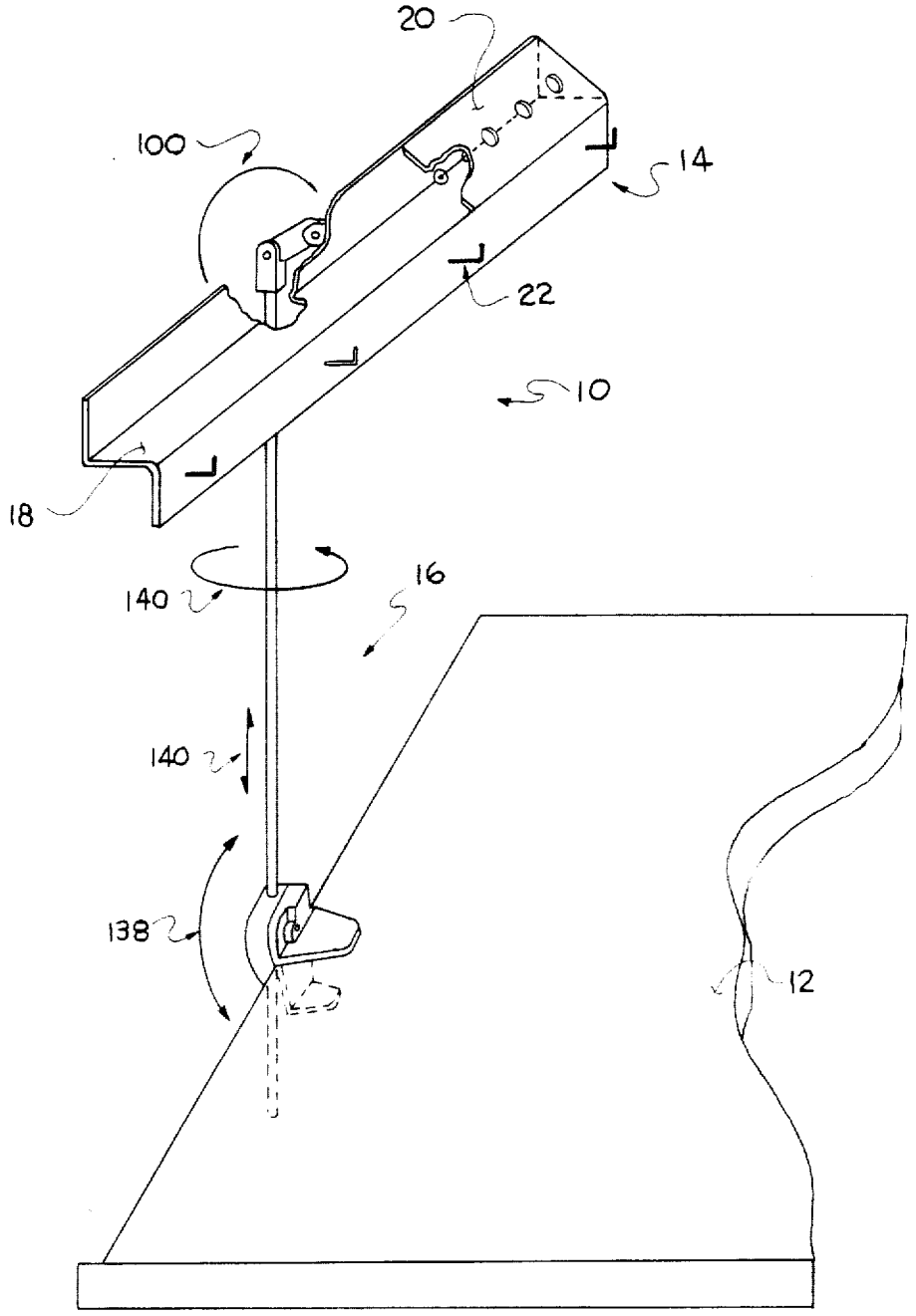
FIG. 1 is a perspective view of the apparatus designed in accordance with a preferred and actual working embodiment of the present invention, shown mounted to an angularly adjustable table top forming part of a drafting table.
Figures 2, 3:
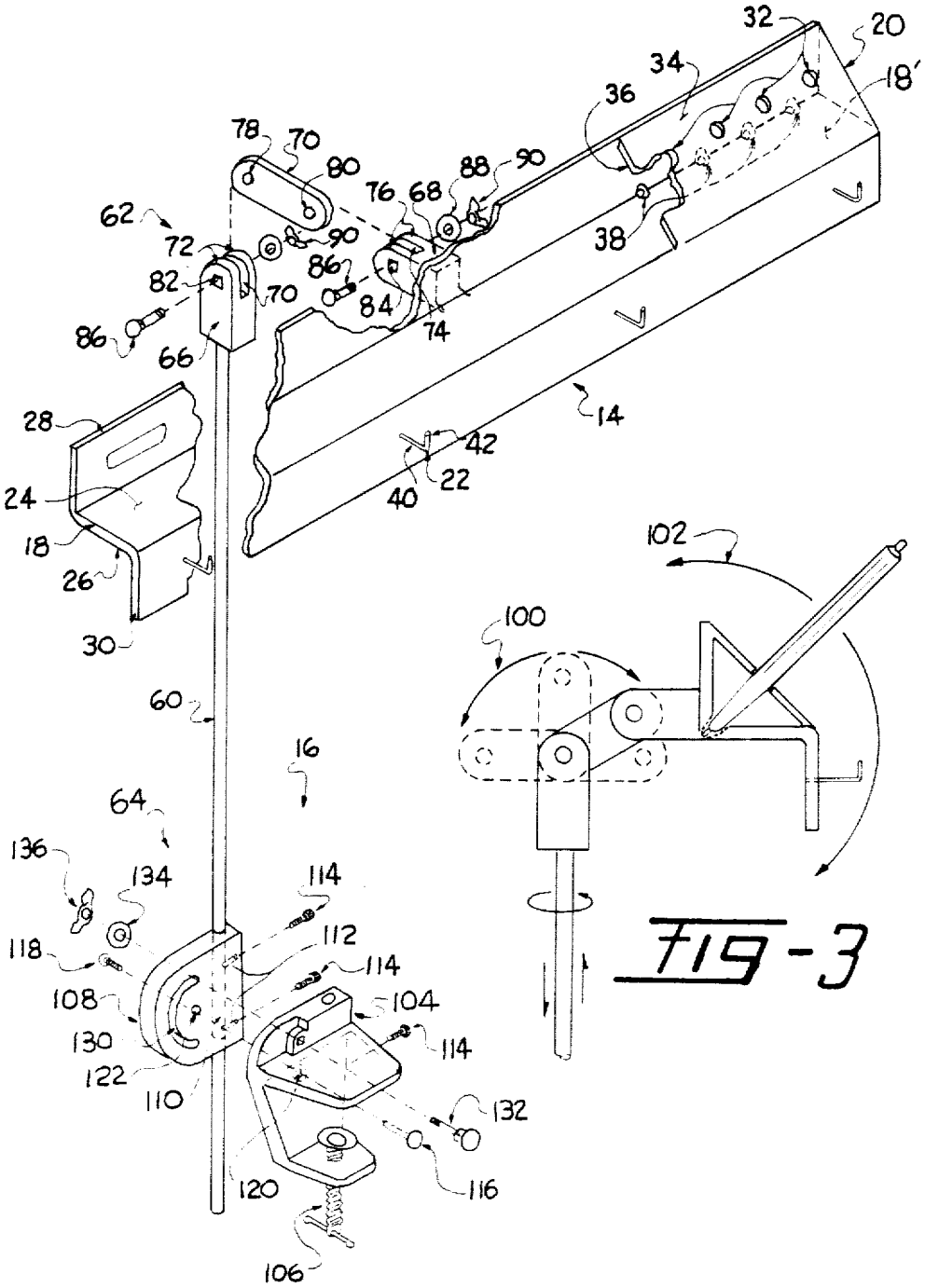
FIG. 2 is an enlarged, exploded perspective view of the apparatus illustrated in FIG. 1.
FIG. 3 is a side elevational view of a top portion of the apparatus illustrated in FIGS. 1 and 2, specifically illustrating certain operational features of the apparatus.
Figure 4:
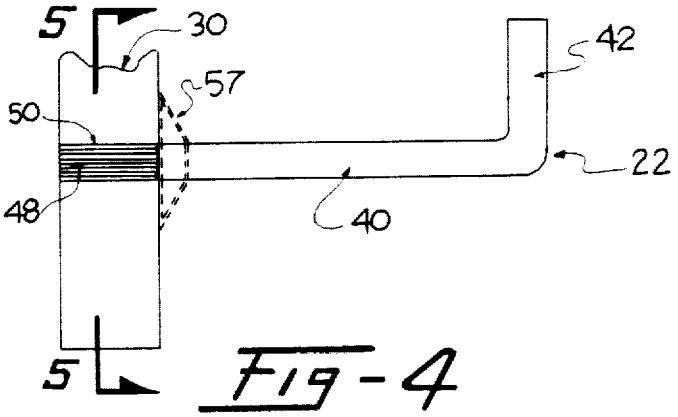
Figure 5:
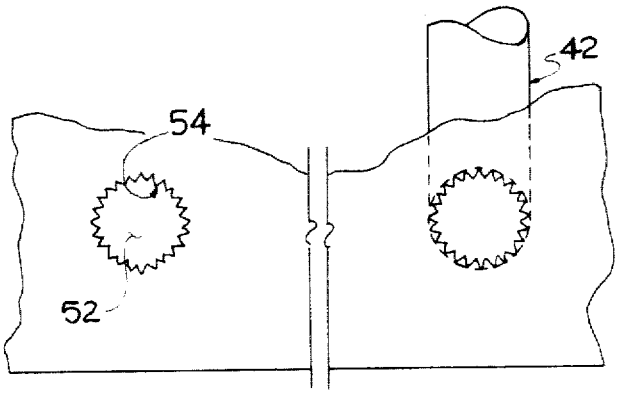
FIG. 5 is a sectional view taken generally along line 5—5 in FIG. 4.
Figure 6:
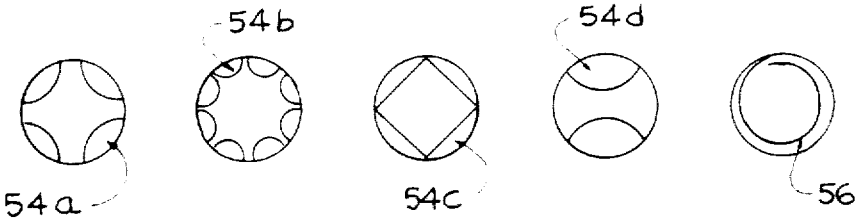
Figure 7:
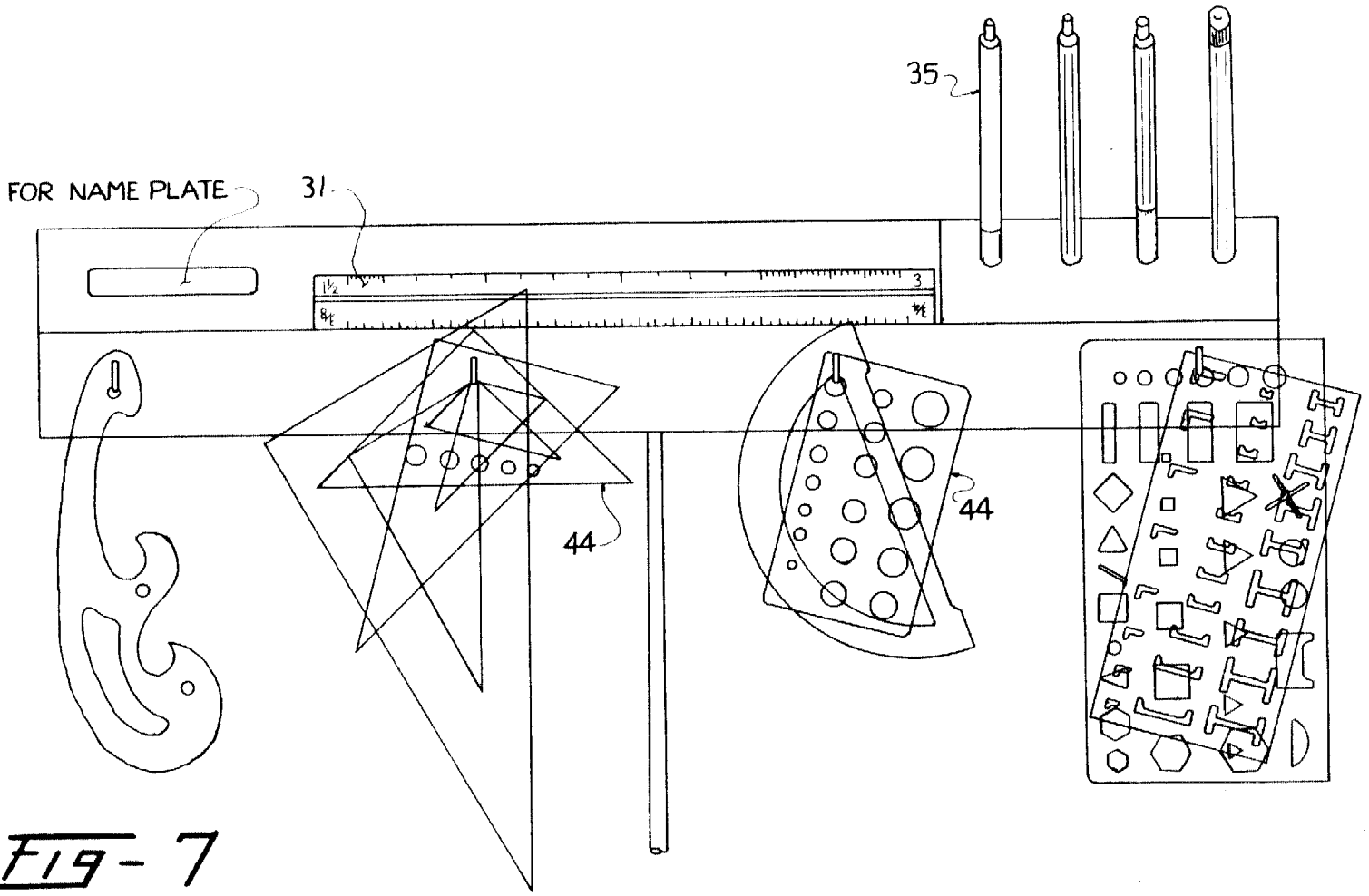
Figure 8:
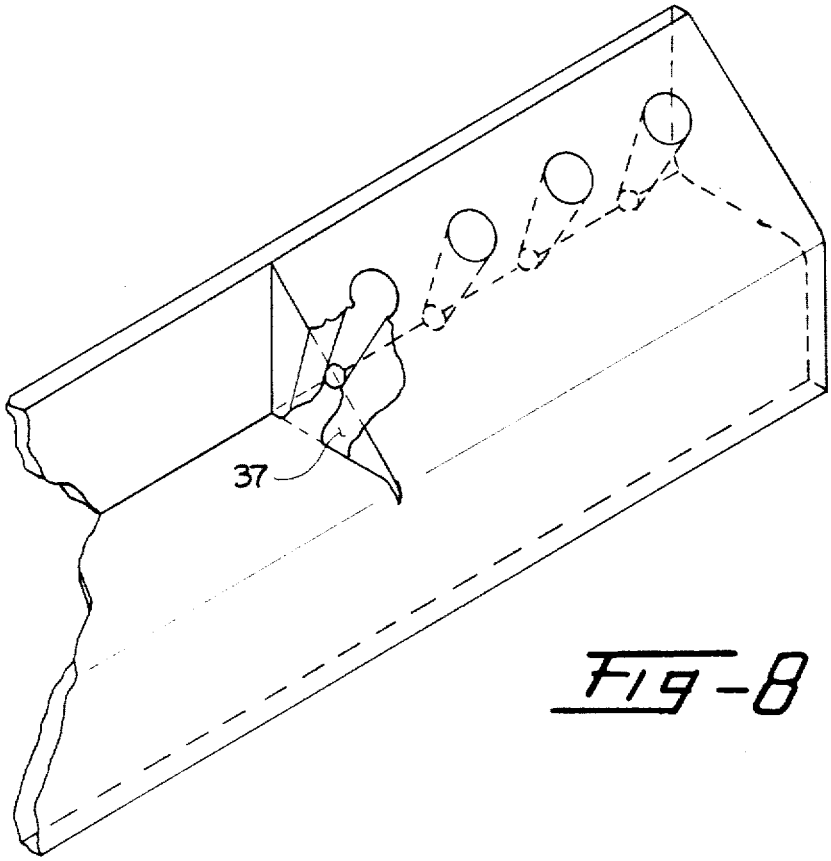

FIG. 6 diagrammatically illustrates certain possible modified features of the apparatus illustrated in FIGS. 1 and 2 and particularly features associated with the hook illustrated in FIGS. 4 and 5;

FIG. 7 is a front elevational view of a top portion of the apparatus illustrated in FIGS. 1 and 2, specifically showing how the apparatus supports various drafting tools; and FIG. 8 illustrates a modified feature of the apparatus of FIG. 1.

Turning now to the drawings, wherein like components are designated by like reference numerals throughout the various figures, attention is first directed to FIG. 1 which, as stated above, illustrates a drafting tool support apparatus designed in accordance with a preferred and actual working embodiment of the present invention. The apparatus, generally indicated by the reference numeral 10, is mounted to an angularly adjustable table top 12 forming part of a drafting table and shown at an incline to the horizontal. Apparatus 10 includes a shelf arrangement 14 for supporting a number of different types of drafting tools and an arrangement generally indicated by the reference numeral 16 for mounting shelf arrangement 14 above and to one edge of the angularly adjustable table top 12, for example to a side or front edge of the table top or even its back edge.

As will be described in more detail hereinafter, shelf arrangement 14 includes, among other components, a longitudinally extending, flat shelf 18 for supporting rulers, erasers and the like; a longitudinally extending plate member 20 designed to support a plurality of upwardly extending pens and/or pencils in spaced-apart relationship to one another; and a plurality of hooks 22 for supporting templates, triangles and the like. As will also be described in more detail hereinafter, arrangement 16 is designed to support shelf arrangement 14 in a number of different adjustable positions relative to table top 12 depending upon the wishes to the draftsman using it. For the moment, it suffices to say that the shelf 18 may be maintained in a longitudinally horizontal position (e.g., having its longitudinal axis horizontal) regardless of the angular position of table top 12 and it may be maintained transversely horizontal (e.g. having its transverse or cross axis horizontal) or it may be tilted transversely in a rearward direction for more reliably supporting rulers, erasers and the like. In addition, the entire shelf arrangement may be adjusted to a limited extent vertically relative to the table top and horizontally relative to its mounting edge. The shelf arrangement may also be rotated about a vertical axis, again relative to the drafting table top.

Turning to FIG. 2, attention is directed to the various components making up shelf arrangement 14. As seen in this latter figure, the shelf arrangement includes the previously recited longitudinally extending shelf 18 having a top side 24 for receiving rulers, erasers and the like and bottom side 26. A back wall 28 extends up from the back longitudinal edge of shelf 18 along the entire length of the latter and is preferably perpendicular thereto. A longitudinal front wall 30 extends down from the front longitudinal edge of shelf 18 along the entire length of the latter and is also preferably perpendicular thereto. These three components, that is, shelf 18 and the front and back walls just described may be separately made components formed from any suitable material such as hard plastic but are preferably molded, extruded or otherwise integrally formed as a single unit.

As just stated, shelf 18 serves to support rulers, erasers and the like on its top surface 24. This is best illustrated in FIG. 7 where a ruler is shown on the shelf at 31. Back wall 28 serves to prevent the ruler and other small items such as erasers from falling off of the back edge of the shelf. In this regard, by transversely tilting the shelf in a rearward direction so that its front edge is higher than its back edge, any items supported thereon are less likely to inadvertently fall off its unobstructed front edge and are thereby more reliably supported on the shelf.

Still referring to FIG. 2, shelf arrangement 14 is also shown including the previously recited plate member 20. This longitudinally extending plate member is fixedly connected along its bottom longitudinal edge to the front longitudinal edge of a section 18' of shelf 18 and extends upwardly and rearwardly therefrom over and above shelf section 18'. In the particular embodiment illustrated, plate member 20 defines a 45° angle with shelf 18 but could be readily designed to define other acute angles. Also, the lowermost longitudinal edge of the plate member is shown integrally formed with shelf 18 and front wall 30 while its top longitudinal edge is shown connected with or at least engaging the top front edge of back wall 28. To provide this particular configuration, the combination shelf, front and back walls and plate member would most likely have to be molded and could not readily be extruded. Certainly, it is possible to form the plate member separate from the shelf and fixedly connect them together. In either case, it is not necessary, although preferable, to make the plate member sufficiently wide to extend entirely between the front edge of shelf 24 and the top edge of back wall 28.

Regardless of how plate member 20 is made, it is provided with a plurality of through-holes 32 extending from its front face 34 to its back face 36. As best illustrated in FIG. 7, these through-holes serve to receive and contain pens and/or pencils generally indicated at 35. As seen in this latter figure, these pens and/or pencils are supported in spaced-apart relationship to one another and extend upwardly relative to shelf 24. In a preferred embodiment of the present invention, the shelf arrangement includes a plurality of openings or wells 38 for receiving and protecting the points of the pens and/or pencils 35 when the latter are placed in openings 32. These wells also serve to prevent the front ends of the pens and/or pencils from sliding laterally and possibly out of openings 32. To this end, the wells may be provided in shelf 18 or they could possibly be provided in back wall 28, depending upon the positions of openings 32 in plate member 20. However, in the embodiment shown, the wells are located at the inside corner joining the shelf and rear wall, as best illustrated in FIG. 2. The way in which a given well receives the point of a given pen or pencil is best illustrated in FIG. 3. As an alternative, a solid shelf segment, triangular in cross section, could be provided with sufficiently deep holes to receive front end sections of the pens and/or pencils including their respective tips. This segment would be provided in place of the plate 20 and shelf segment thereunder. This is shown in FIG. 8 at 37.

In addition to the various components thus far described, shelf arrangement 14 includes the previously described plurality of hooks 22. The particular hooks utilized in the embodiment illustrated include rearward straight segments 40 and forwardmost upstanding segments 42. The hooks are longitudinally spaced from one another along the length and in front of front wall 30 and the rearwardmost ends of segments 40 are fixedly disposed within cooperating openings in the front wall in the manner to be described below. As stated previously, these hooks serve to support templates, triangles and the like, as best illustrated in FIG. 7 where these various drafting tools are generally indicated by the reference numeral 44. Note that each hook is designed to support a number of templates and/or triangles in a way which allows all of them to be readily identified and easily found by the draftsman.

Referring to FIGS. 4 and 5, one of the hooks 22 is shown in detail. Of particular interest in these figures is the rearwardmost section of hook segment 40. This section which is indicated at 48 is shown including longitudinally extending serrations or actually splines 50 which are circumferentially spaced apart from one another entirely around the end section. This serrated or splined end section of hook segment 40 is disposed within a through-hole 52 in front wall 30. The through-hole includes grooves 54 (see FIG. 5) which cooperate with the serrations or splines 50 for preventing end section 48 from rotating within through-hole 52 and hence for preventing the entire hook from rotating relative to front wall 30. Thus, once the end section 48 is disposed within a cooperating hole 52 and preferably fixedly held against longitudinal movement by means of a force fit or by suitable bonding adhesive such that the front segment 42 of the hook extends upward, the front segment 42 will tend to remain in this vertically upwardly extending position and thereby reliably retain the templates and triangles. Various groove configurations for hole 52 are illustrated in FIG. 6 at 54A–54D. In addition, it is possible to provide cooperating threads rather than a spline and groove arrangement as indicated at 56 in FIG. 6. In any case, a cover cap may be provided as indicated in dotted lines at 57 in FIG. 4 in combination with each hook.

Having described shelf arrangement 14 and the way it functions to support rulers, erasers, pens and pencils, triangles, templates, and the like, attention is now directed to arrangement 16 which, as stated previously, supports the shelf arrangement to the mounting edge of table top 12. To this end, arrangement 16 includes a straight, rigid post 60, an assembly of components 62 which serves to connect shelf arrangement 14 to the top end of post 60 and an assembly of components 64 which serves to connect the post to the mounting edge of table top 12 at a point along the post below the shelf arrangement.

As best illustrated in FIGS. 2 and 3, assembly 62 takes the form of an arrangement of links 66, 68 and 70. Link 66 is fixedly connected to the top end of post 60 by any suitable means such as bonding adhesive, a force fit or cooperating threads. Link 68 is bonded or otherwise suitably connected to (for example integrally so) and extends rearwardly from the back side of back wall 28 forming part of shelf arrangement 14. Link 70 which is elongated in shape is designed for pivotal connection at its opposite ends to the links 66 and 68. In order to provide for this, link 66 defines a groove 70 between opposing end sections 72 and link 68 defines a similar groove 74 between opposing end sections 76. Opposite end sections of link 70 include through-hole 78 and 80 which are designed to align with cooperating through-holes 82 and 84 in link sections 72 and 76 when the ends of link 70 are positioned in the proper manner within grooves 70 and 74. With link 70 so positioned, carriage bolts 86 are disposed through the cooperating holes and held in place by cooperating washers and wing nuts 88 and 90, respectively.

The various components making up assembly 62 as described immediately above are configured so that the middle link 70 is free to pivot at its opposite ends about the carriage bolts 86 within recesses 70 and 74 when the wing nuts connected to these carriage bolts are loosened. At the same time, these components are configured so that the link 70 is fixedly held in place within the recesses when the wing nuts are tightened. To this end, end sections 72 and 76 of links 66 and 68 must be slightly flexible or resilient.

With the way in which the linkage arrangement making up assembly 62 operates, the overall shelf arrangement 14 can be rotated about the axis of opening 82 through link 66 as indicated by arrow 100 illustrated in FIGS. 1 and 3 and fixedly maintained in any position along this path. At the same time, the shelf arrangement can be rotated about the axis of holes 84 as indicated by arrows 102 (FIG. 3 only) in order to maintain shelf 24 in a horizontal position. This makes it possible not only to adjust the shelf, actually the entire shelf arrangement, vertically to a limited extent but also horizontally, again to a limited extent, relative to table top 12. On the other hand, by appropriately manipulating the links making up assembly 62, the shelf arrangement can be tilted about either or both of the axes through holes 82 and 84 in order to tilt shelf 18 such that its front edge is higher than its back edge, thereby allowing it to more securely support its rulers, erasers and the like.

Returning to FIG. 2, attention is now directed to the various components making up assembly 64 which, as stated previously, serves to connect post 60 to the mounting edge of table top 12. As illustrated in this figure, assembly 64 includes a clamping device 104 and cooperating clamping screw 106 designed for conventional connection to a table edge such as table top 12. The assembly also includes a support base 108 for the clamping device. This base includes a through-hole 110 for slidably receiving support post 60 and one or more cooperating side openings 112 adapted to receive cooperating set screws 114 which are designed to engage against post 60 for maintaining base 108 in a fixed position along the length of post 60. A post extension 116 and post extension screw 118 also form part of assembly 64 and respectively extend through cooperating openings 120 and 122 in the clamping device and base, respectively, for connecting the clamping device and base together while allowing the latter to rotate about the axis of the post extension relative to the latter.

As seen in FIG. 2, base 108 includes an arcuate through slot 130 configured to receive a carriage bolt 132 which cooperates with a washer 134 and wing nut 136 in order to fix the rotational position of the base relative to the clamping device 108. This, in turn, allows the post 60 and the entire shelf arrangement 14 to pivot about post extension 116, as indicated by arrow 138 in FIG. 1, for maintaining shelf 24 longitudinally horizontal regardless of the incline of table top 12. Bolt 132 and cooperating slot 130 together serve as a guide and the wing nut is either loosened to adjust the pivotal position of post 60 or tightened to fix its position. At the same time, the set screw 114 can be loosened to vertically raise or lower the post 60 as indicated by arrow 140 in FIG. 1, or rotate the post about its own axis, as indicated by arrow 142 in FIG. 1.

The overall shelf arrangement 14 has been described in combination with means for supporting it to a drafting table. It is to be understood that this arrangement could be supported by suitable means to a wall or other such vertical support surface.

What is claimed is:

1. A drafting tool support apparatus especially suitable for mounting to an angularly adjustable table top of a drafting table, said apparatus comprising:

(a) a shelf arrangement including (i) means defining a longitudinally extending flat shelf for supporting rulers, erasers and the like, (ii) means fixedly located above a longitudinal section of said shelf for supporting a plurality of upwardly extending pens and/or pencils in spaced-apart relationship to one another, and said pen and/or pencil supporting means including a longitudinal plate member fixedly connected above a longitudinal section of said shelf and transversely inclined at an acute angle with the latter in longitudinally parallel relationship therewith, said plate member including a front face, a back face and a plurality of holes therethrough for respectively receiving and containing said pens or pencils at an acute incline with said shelf (iii) means including a plurality of hooks for supporting templates, triangles and the like; and (b) means for mounting said shelf arrangement over and to one edge of the angularly adjustable top of said drafting table so as to adjustably maintain said shelf in a longitudinally horizontal position and said pens and/or pencils in upwardly extending positions regardless of the angular position of the table top.

2. An apparatus according to claim 1 wherein said mounting means includes means for adjusting within limits the vertical position of said shelf arrangement relative to the working surface of said table top.

3. An apparatus according to claim 1 wherein said mounting means includes a post extending between the mounting edge of said table and said shelf arrangement and means for adjusting within limits the horizontal position of said shelf arrangement relative to said post and the mounting edge of said table top.

4. An apparatus according to claim 1 wherein said mounting means includes a support post extending between said table top and shelf arrangement and means for adjusting the position of said shelf arrangement at any point about said post.

5. An apparatus according to claim 1 wherein said shelf arrangement includes a longitudinal back wall extending up from the back longitudinal edge of said shelf and wherein said mounting means includes means for adjustably tilting said shelf and back wall transversely such that the shelf tilts downward from its front longitudinal edge to said back edge, whereby to more reliably support rulers, erasers and the like thereon.

6. An apparatus according to claim 1 wherein said mounting means includes a support post extending between said table top and shelf arrangement, means connecting said post at a point thereon to the mounting edge of said table top for rotation about an axis through said point and normal to said post, and means for adjustably fixing the rotational position of said post about said axis whereby to maintain said shelf in said longitudinally horizontal position regardless of the angular position of said table top.

7. An apparatus according to claim 6 wherein said pen and/or pencil supporting means includes means defining a plurality of openings equal in number to said holes and respectively aligned with the latter in confronting relationship with the back face of said plate member for receiving and protecting the tips of said pens and/or pencils.

8. An apparatus according to claim 7 wherein means defining said openings includes said shelf, at least in part.

9. An apparatus according to claim 8 wherein said shelf arrangement includes a back wall extending up from the back longitudinal edge of said shelf so as to define a longitudinally extending corner with the latter and wherein said openings are disposed partially in said shelf and partially in said back wall at said corner.

10. An apparatus according to claim 1 wherein said hook including means includes a longitudinal front wall extending down from the front longitudinal edge of said shelf and wherein each of said hooks includes a rearward segment fixedly disposed within a cooperating opening in said front wall and a front upwardly extending segment for containing said templates, triangles, and the like.

11. An apparatus according to claim 10 wherein the rearward segments of each of said hooks and their respective openings are configured to cooperate with one another in a non-threaded fashion for preventing the front segment of the hook from rotating.

12. An apparatus according to claim 11 wherein the rearward segment of each hook and its cooperating opening define an array of splines and cooperating grooves extending parallel with and circumferentially around the axis of the opening for supporting the hook and preventing its front segment from rotating.

13. A drafting tool support apparatus especially suitable for mounting to an angularly adjustable table top of a drafting table, said apparatus comprising:

(a) a shelf arrangement including means defining a longitudinally extending, planar shelf and back wall for supporting rulers, erasers and the like and means including a plurality of hooks for supporting templates, triangles and the like; and (b) means for mounting said shelf arrangement over and to one edge of the angularly adjustable top of said drafting table, said mounting means including (i) a longitudinally extending post, (ii) means pivotally connecting said shelf arrangement with a top end of said post for permitting said shelf arrangement to be fixedly maintained in different horizontal positions relative to said post and to the mounting edge of said table top such that these different positions define different distances horizontally from the top of said post while said shelf is maintained in a horizontally extending position and which also allows the shelf and said back wall to be tilted transversely such that the shelf tilts downwardly from its front longitudinal edge to said back edge, whereby to more reliably support rulers, erasers and the like thereon, and (iii) means for connecting said post to the mounting edge of said drafting table at a point below said shelf arrangement which allows said shelf to be maintained in a longitudinally horizontal position regardless of the angular position of said table top and which within limits, allows the position of the shelf arrangement to be adjusted vertically relative to said table top, and which also allows the post to be rotated about its axis for adjusting the position of said shelf arrangement at any point around said post.

14. An apparatus according to claim 13 wherein said shelf arrangement includes means for supporting a plurality of upwardly extending pens and/or pencils in spaced-apart relationship to one another.

15. An apparatus according to claim 14 wherein:

(a) said pen and/or pencil supporting means includes a longitudinal plate member fixedly connected above the longitudinal section of said shelf and transversely inclined at an acute angle with the latter in longitudinally parallel relationship therewith, said plate member including a front face, a back face and a plurality of holes therethrough for respectively receiving and containing said pens or pencils at an acute angle with said shelf, said pen and/or pencil supporting means also including a plurality of openings equal in number to said holes and at least partially defined by said shelf for receiving and protecting the tips of said pens and/or pencils; and (b) said hook including means includes a longitudinal front wall extending down from the front longitudinal edge on said shelf, each of said hooks includes a rearward segment fixedly disposed within a cooperating opening in said front wall and a front upwardly extending segment for containing said templates, triangles and the like, said rearward segment of each of said hooks and its respective opening being configured to cooperate with one another in a non-threaded fashion for preventing the front segment of the hook from rotating.

16. A drafting tool support apparatus for mounting to the table top of a drafting table or to a wall or the like, said apparatus comprising:

(a) a shelf arrangement including (i) means defining a longitudinally extending, flat shelf for supporting, rulers, erasers and the like, a longitudinal back wall extending up from the back longitudinal edge of said shelf, and a longitudinal front wall extending down from the front longitudinal edge of said shelf, (ii) a longitudinally extending plate member fixedly connected above a longitudinal section of said shelf and transversely inclined at an acute angle with the latter in longitudinally parallel relationship therewith, said plate member including a front face, a back face and a plurality of holes therethrough for respectively receiving and containing pens or pencils at an acute incline with said shelf, said shelf and back wall together defining a plurality of openings at the corner adjoining the two, said openings being equal in number to said holes and being respectively aligned with the latter in confronting relationship with the back face of said plate member for receiving and protecting the tips of said pens and/or pencils, and (iii) a plurality of hooks fixedly connected to said front wall for supporting templates, triangles and the like.

* * * * *